United States Patent [19]

Mathes et al.

[11] 4,222,326

[45] Sep. 16, 1980

[54] MECHANISM FOR CONTROLLING AND SMOOTHING A CONVEYED SHEET IN A MULTI-COLOR PRINTING PRESS PARTICULARLY APPLICABLE TO PRINTING IN THE VERSO MODE

[75] Inventors: Josef Mathes, Offenbach am Main; Rudolf Melzer, Hainburg, both of Fed. Rep. of Germany

[73] Assignee: M.A.N.-Roland Druckmaschinen Aktiengesellschaft, Fed. Rep. of Germany

[21] Appl. No.: 15,640

[22] Filed: Feb. 27, 1979

[51] Int. Cl.[3] ..... B41F 5/16

[52] U.S. Cl. ..... 101/183; 101/232; 38/143; 271/183

[58] Field of Search ..... 101/183, 230, 232, 184, 101/382 MV; 271/92, 183; 38/2, 143

[56] References Cited

U.S. PATENT DOCUMENTS

| | | | |
|---|---|---|---|
| 1,306,086 | 6/1919 | Turck | 101/183 |
| 3,076,492 | 2/1963 | Monks | 271/183 |
| 4,015,522 | 4/1977 | Preuss | 101/183 |
| 4,060,236 | 11/1977 | Carstedt | 101/232 |

FOREIGN PATENT DOCUMENTS

| | | | |
|---|---|---|---|
| 2452096 | 7/1975 | Fed. Rep. of Germany | 101/232 |
| 2807151 | 8/1979 | Fed. Rep. of Germany | 101/232 |

*Primary Examiner*—Paul T. Sewell
*Assistant Examiner*—A. Heinz
*Attorney, Agent, or Firm*—Leydig, Voit, Osann, Mayer & Holt, Ltd.

[57] ABSTRACT

A multi-color printing press including a first press unit and a second press unit with a conveyor interposed between them, the conveyor including a sprocket drum cooperating with a transfer drum on the second press unit. A pair of plenums having apertured faces alined with one another are arranged closely adjacent the feed side of the sprocket drum, the plenums being connected to a source of vacuum. The plenums are cammingly coupled to the press drive for axial spreading movement during passage of a sheet so that the faces of the plenums progressively wipe away any longitudinally extending as well as laterally extending wrinkles in the sheet as the sheet becomes progressively supported on the sprocket drum for sequential passage of the sheet in smooth condition and in accurate register via the sprocket and transfer drums, the action of the plenums being effective both in the recto and verso printing modes. A further cammed connection is provided for supporting the plenums with their faces spaced from the surface of the sprocket cylinder and for cyclically lowering the plenums into close proximity to the sprocket drum during passage of each sheet.

11 Claims, 9 Drawing Figures

Figures 1, 1A, 1B, 2:
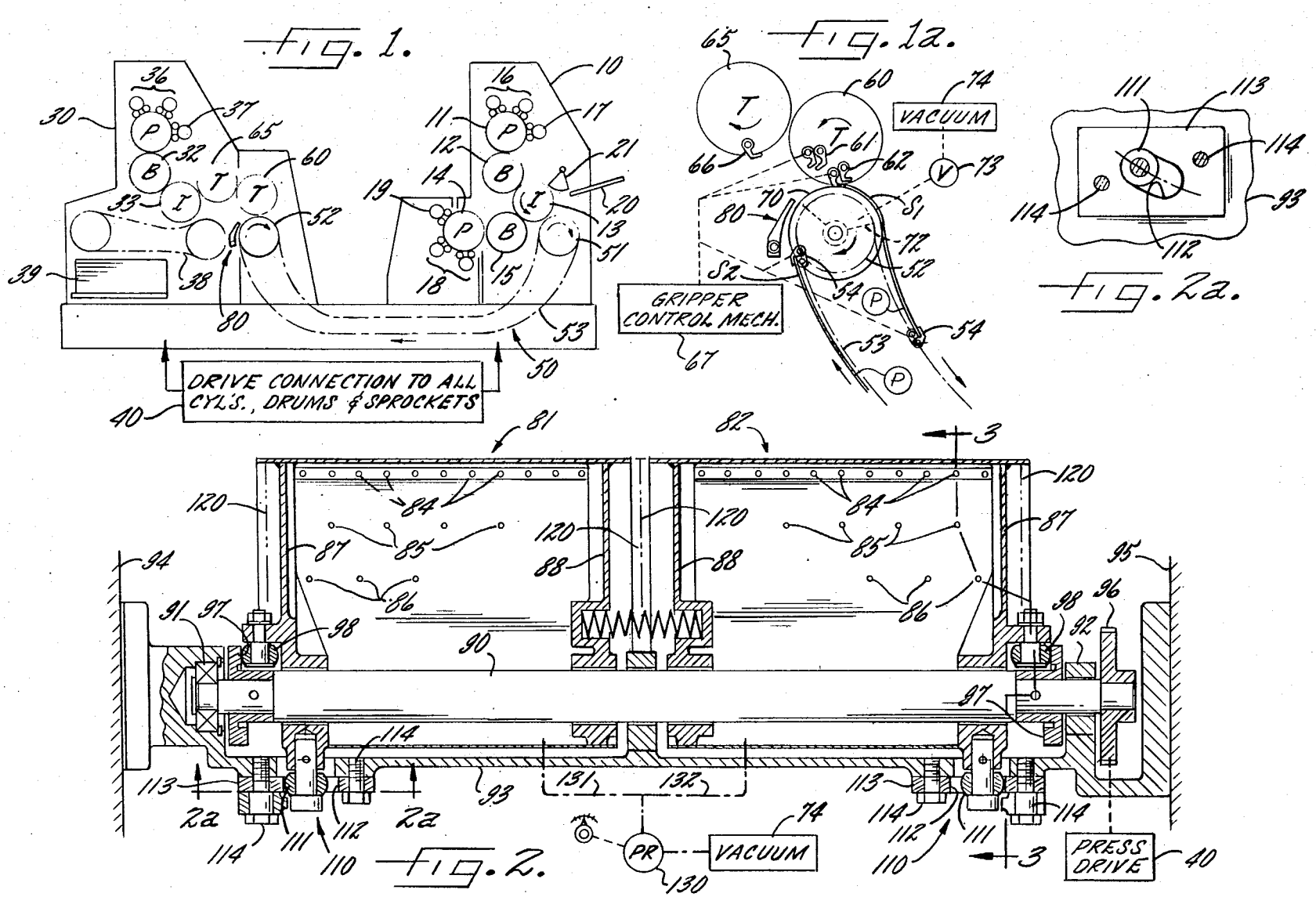

MECHANISM FOR CONTROLLING AND SMOOTHING A CONVEYED SHEET IN A MULTI-COLOR PRINTING PRESS PARTICULARLY APPLICABLE TO PRINTING IN THE VERSO MODE

In sheet-fed printing presses capable of printing in both the recto and verso modes it is necessary, in the latter mode, to reverse the direction of travel of the sheet. To preserve a condition of register as the sheet is transferred from the sprocket drum to the transfer drum of a second press unit it is desired to have the sheet in smooth condition and reliably adherent to the sprocket drum. Thus in German publication DE-AS 2,452,096 there is disclosed a special sprocket drum which includes a number of rotating suckers provided with eccentrically arranged suction openings to tighten the sheet in both directions upon the sprocket drum prior to passage of the sheet to the associated transfer drum. One disadvantage of this arrangement is that the sheet is subjected to the stretching action of the suckers only after it has been deposited upon the sprocket drum. For this reason, and the fact that the suckers act only at the end of the sheet, wrinkles which have formed at the front edge of the sheet, especially longitudinal wrinkles, cannot be smoothed out. Furthermore the eccentricity of the suction bores may provide insufficient throw to remove major wrinkles, especially wrinkles extending in the longitudinal or sheet-travel direction.

It is, accordingly, an object of the present invention to provide, in a press capable of operating in the recto and verso modes, means for progressively removing longitudinally extending as well as laterally extending wrinkles while the sheet is on the conveyor and before the sheet becomes drum supported. More specifically it is an object to provide means for insuring that the sheet is in smooth condition, with any wrinkles being wiped away, before the sheet engages the sprocket drum for sequential passage of the sheet in smooth condition and in accurate register to the sprocket and transfer drums.

It is a related object to provide means which insures control of fluttering action in a sheet carried by a high speed conveyor and for removing any wrinkles resulting therefrom, by engagement with the unprinted side, before the previously printed side of the sheet engages the sprocket drum thereby to avoid any possibility of smearing the printed impression.

It is a more specific object of the invention to provide a pair of apertured plenums having alined faces axially movable in opposite directions to facilitate removal of longitudinally extending wrinkles and in which the apertues are arranged in a two-dimensional pattern for distribution of the wiping forces over a large area of the sheet thereby to minimize development of localized stress within the sheet. In short, each sheet is treated gently with no risk that the sheet will become warped or torn incident to the smoothing process.

It is a general object of the invention to provide means which not only insures that each sheet is deposited smoothly and in sequence on the sprocket and transfer drums but which further insures maintenance of a high degree of accuracy in register in both the recto and verso printing modes.

It is a further and more detailed object of the present invention to impart to the plenums not only a spreading movement but also a movement toward and away from the sprocket cylinder, with the plenums being retracted to permit clear passage of the conveyor grippers and lowered into close engagement to the sheet for acting thereon after the grippers have passed by.

It is, finally, an object of the invention to provide an improved mechanism for insuring that a conveyed sheet is flatly applied to a receiving drum in accurate register, a mechanism which has wide utility on both new and existing designs of presses, which is simple and economical in construction and which is capable of operating reliably with minimum maintenance for long periods of time.

Other objects and advantages of the invention will become apparent upon reading the attached detailed description and upon reference to the drawings in which:

FIG. 1 is a diagrammatic side view of a two-unit printing press including the present invention.

FIG. 1*a* is an enlarged fragmentary view of a portion of the downstream press unit of FIG. 1 during operation in the verso mode.

Figure 3:
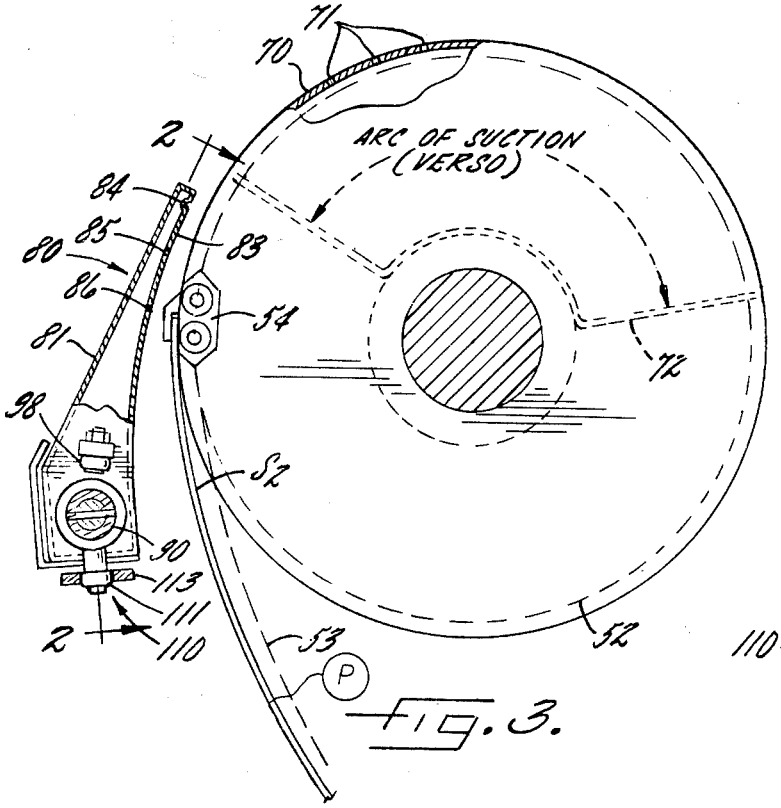

FIG. 2 is an axial cross section taken through the pair of plenums employed in the present invention, looking along line 2—2 in FIG. 3, with the two plenums shown in their spread-apart condition.

FIG. 2*a* shows the profile of the cam and cam follower imparting rocking movement to the associated plenum looking along line 2*a*—2*a* in FIG. 2.

FIG. 3 shows an end view of the sprocket drum with an associated plenum being shown, in typical transverse section, along line 3—3 in FIG. 2.

Figure 3A:
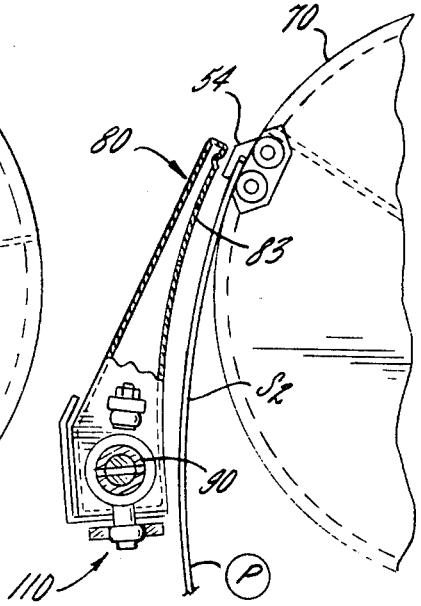
Figure 3B:
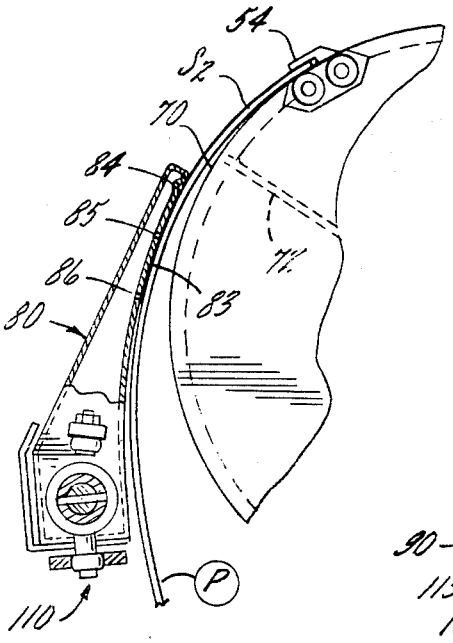
Figure 3C:
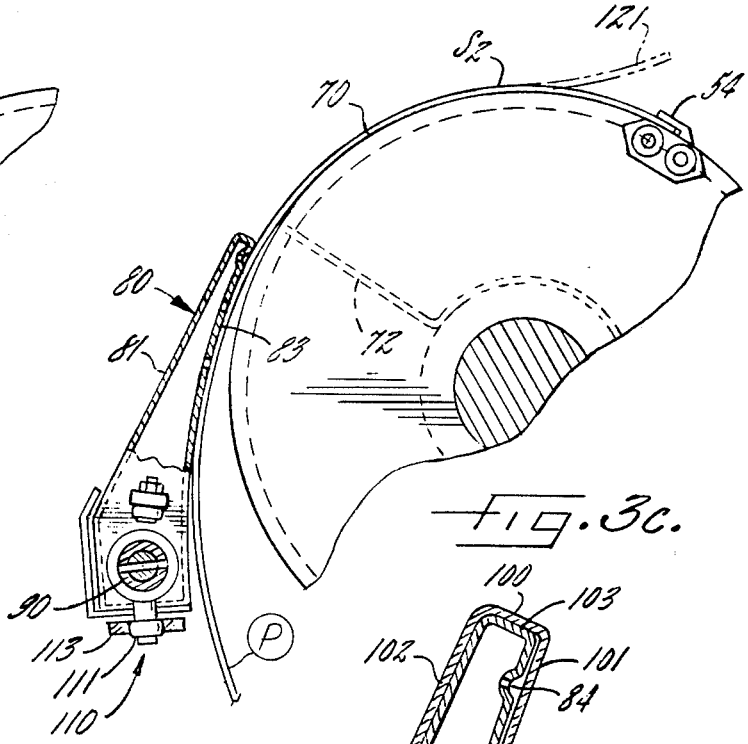

FIGS. 3*a*, 3*b* and 3*c* are stop motion views based upon FIG. 3.

Figure 4:
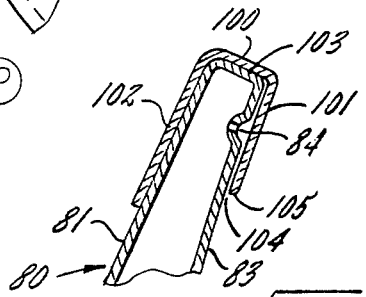

FIG. 4 is a typical cross section showing the preferred construction of the downstream edges of the plenums utilizing an end cap defining a continuous slot for exerting suction on the sheet.

While the invention has been described in connection with a preferred embodiment, it will be understood that we do not intend to be limited to the particular embodiment shown but intend, on the contrary, to cover the various alternative and equivalent forms of the invention included within the spirit and scope of the appended claims.

Turning now to FIG. 1 there is disclosed a printing unit 10 having a first plate cylinder 11, a first blanket cylinder 12 and an impression cylinder 13. Cooperating with the impression cylinder is a second plate cylinder 14 and associated blanket cylinder 15. The plate cylinder 11 has an inking system 16 and dampening system 17 while the plate cylinder 14 is provided with an inking system 18 and dampening system 19. Sheets are fed into the press via a feed table 20, the sheets being transferred individually from a registered position on the feed table to the impression cylinder 13 by a swing gripper 21.

To accomplish additional printing, either on the same side of the sheet or on the reverse side, a second printing unit 30 is provided having a plate cylinder 31, blanket cylinder 32 and impression cylinder 33. The plate cylinder has an inking system indicated at 36 and a dampening system 37. A printed sheet is taken from the impression cylinder 33 by a delivery conveyor 38, which is of conventional construction, and deposited by the conveyor upon a delivery pile 39.

All of the cylinders, drums and sprockets are driven in synchronism by drive connections which are not shown but which are generally indicated at 40.

For conveying sheets between the press units a conveyor 50 is used having inlet and outlet sprockets 51, 52 about which is trained a conveyor chain 53 having a series of grippers 54 (see also FIG. 1*a*).

Arranged adjacent the outlet sprocket 52 is a first transfer drum 60 having a normal set of grippers 61, capable of gripping the leading edge of a sheet, and an auxiliary set of grippers 62, capable of gripping the trailing edge, in the recto and verso modes, respectively. From the first transfer drum 60 the sheet is transferred to a second transfer drum 65 having a set of grippers 66 and which serves to transfer the sheet to the impression cylinder 33.

In the operation of the press in its recto mode, that is, where both press units contribute toward multi-color printing on a single side of the sheet, the auxiliary grippers 62 on the first transfer drum are retracted and silenced and the normal set of grippers 61 is effective to transfer a sheet from the outlet sprocket to the second transfer drum 65. However, in the verso mode, the auxiliary grippers 62 are activated to grip the tail of a sheet, indicated at S1, as shown in FIG. 1*a*, with the action of the grippers being thereafter coordinated so that the grippers 62, during rotation of the transfer drum 60, transfer the engaged end of the sheet to the normal set of grippers 61. The means for controlling, or synchronizing the action of the grippers is shown diagrammatically at 67. For a more detailed disclosure of this portion of the structure, reference is made to prior Preuss et al. U.S. Pat. No. 4,015,522 which issued Apr. 5, 1977, to Weisgerber U.S. Pat. No. 3,796,154 which issued Mar. 12, 1974 and to Gegenheimer et al. U.S. Pat. No. 2,757,610 which issued Aug. 7, 1956.

In structures of the above type intended for printing in the verso mode, a sprocket drum 70 is associated with the outlet sprocket 52 and on which the sheet is supported for transfer to the transfer cylinder 60. The sprocket drum 70 is apertured, as at 71, and evacuated so that the supported sheet is immobilized thereon by suction. Internal structure within the drum 70 is preferably provided to limit the arc of suction to only a fraction of the drum periphery, with the arc of suction remaining stationary while the drum rotates. Means for accomplishing this is shown in the above-mentioned U.S. Pat. No. 4,015,522. For present purposes it may, for simplicity, be assumed that the arc of suction is defined by an internal barrier 72 which is connected via a valve 73 to a source of vacuum 74 (FIG. 1*a*).

In accordance with the present invention a pair of vacuum plenums having apertured faces are arranged closely adjacent the feed side of the sprocket drum and spanning substantially the width of the sheet. A mechanical connection coupled to the press drive and timed with the arrival of a sheet produces axial spreading of the plenums mutually outwardly during passage of the sheet so that the apertured faces of the plenums, in sucking engagement with the sheet, progressively wipe away any longitudinally extending as well as laterally extending wrinkles in the sheet as the sheet becomes progressively supported on the sprocket drum.

Thus, referring to FIGS. 2 and 3, there is provided a plenum assembly 80 having left and right-hand sections 81, 82. Taking the left-hand section 81 as typical, it is in the form of an enclosed vacuum chamber having an arcuate face 83 with a two-dimensional pattern of apertures arranged in rows 84, 85, 86. The plenum has structural end walls 87, 88 penetrated by a shaft 90 supported in bearings 91, 92. The bearings are supported upon a bracket 93 which, in turn, is anchored between the press end walls 94, 95.

As will be seen in FIG. 2, the plenums 81, 82 are preferably in the form of symmetrical mirror images of one another and, accordingly, elements have been given corresponding reference numerals.

In accordance with one of the important features of the present invention a mechanical connection is made with the press drive and which is effective to cause the plenums 81, 82 to spread mutually outwardly, away from one another in the axial direction, timed with engagement of a passing sheet on the conveyor so that a sheet, attracted by suction to the faces of the plenums, is wiped and lightly stretched on the axial and longitudinal directions. This effectively controls any fluttering of the sheet which may exist as it reaches the end of the conveyor and progressively removes any longitudinally extending, as well as laterally extending, ripples or wrinkles in the sheet just prior to the sheet's being deposited upon the surface of the sprocket drum 70. The axial wiping movement, timed with the arrival of the sheet, is brought about by coupling the shaft 90 via a sprocket or the like 96 to the press drive 40 and by interposing between the shaft 90 and each of the plenums 81, 82 a mechanical connection including a cam 97 of the end-facing or "crown" type and a cam follower 98. The cams 97 work against a central compression spring 99, and, since the cams 97 face mutually inwardly, the effect is to squeeze the plenums inwardly toward one another on the rise of the cams, with the spring being subsequently effective to bring about the above-mentioned spreading action when the cams 97 are in the retreating phase. The phasing of the shaft 90 is so timed that the plenums move mutually inward, with cocking action, between successive sheets and mutually outward, with spreading action, during the interval that a sheet is engaged.

It is one of the features of the present invention that the apertures 84, 85, 86 in the face 83 of the plenum are spread in a wide two-dimensional pattern so that the wiping forces are distributed over a large area of the sheet thereby to minimize development of localized stress within the sheet. Moreover, in the preferred construction, the apertures are not uniformly distributed but are concentrated at the remote axial end portions of the plenum faces thereby concentrating the effect of suction along the lateral edges of the sheet.

In accordance with one of the features of the invention, means are provided for applying vacuum substantially uniformly over the width of the sheet along the downstream edge of the plenums. Thus as shown in FIG. 4 a cap 100 in the form of a transversely extending channel of inverted "U" cross section having a front wall 101 and a back wall 102 is superimposed upon the straight upper edge portion 103 of the plenum, the front wall 101 of the cap being spaced forwardly slightly from the plenum face 83, and the openings 84 therein, to define an axially extending evacuated slot 104 which, on the two plenums, extends substantially the full width of the sheet. The overhanging edge of the cap is preferably smoothly rounded as indicated at 105. The continuous slot 104 combined with the spreading action of the plenums and the frictional force induced by the apertures 85, 86 has been found particularly effective in removal of ripples and incipient wrinkles in the sheet extending in both longitudinal and lateral directions. Since the sheet is thus deposited on the sprocket drum 70 in perfectly smooth condition, and remains absolutely stationary thereon, there is no possibility of smearing the previously printed surface indicated at P.

In accordance with one of the further aspects of the present invention means are provided for supporting the plenums 81, 82 with their faces spaced from the surface of the sprocket cylinder for clearing the grippers 54 of the conveyor and for cyclically lowering the plenums into close proximity to the surface of the sprocket drum to insure sucking engagement with the passing sheet after the grippers at the leading edge have safely passed. Such action is achieved by providing a mechanical connection for rocking the plenums through a small angle about the shaft 90 timed in unison with the press drive so that the plenums are rocked inwardly immediately following passage of a gripper. More specifically we provide a cam and cam follower connection 110 inserted between the plenums and the stationary frame of the machine so that the inward rocking movement is derived as the secondary effect of the abovementioned spreading movement.

Thus, connected to the plenum 81 is a cam follower in the form of a roller 111 which is captive in an angled cam slot 112 formed in a cam plate 113 (see FIG. 2*a*), the plate being secured to the frame bracket 93 by means of screws 114. Again, since the right-hand portion of the plenum assembly is the mirror image of the left-hand portion, similar elements are used as identified by corresponding reference numerals, with the understanding that the cam slots 112 are necessarily angled in opposite directions.

The resulting compound motion of the plenums may be understood by considering a typical operating sequence in the verso, or sheet reversing, mode as set forth in FIGS. 3, 3*a*, 3*b* and 3*c*, the sheet being indicated at 52. In the condition shown in FIG. 3, effective during the gap between adjacent sheets on the conveyor, the two plenums 81, 82 are retracted from the sprocket drum to provide clearance for passage of the gripper 54 and, at the same time, the two plenums are drawn into their contracted positions indicated by the dot-dash lines 120 in FIG. 2, corresponding to maximum compression of spring 99. Under such initial conditions the cam followers 98 are at the peaks of their associated cams 97 and the cam followers 111 have a relationship to their cam tracks 112 as illustrated in FIG. 2*a*.

As the gripper 54 begins to clear the downstream edge 103 of the plenums, as illustrated in FIG. 3*a*, the plenums begin their lowering movement. Upon additional rotation of the sprocket drum 70 illustrated in FIG. 3*b* two things occur: the plenums are rocked by the cam follower assemblies 110 so that the faces 83 and apertures therein are lowered into close proximity to the drum, thereby picking up the sheet, and the two plenums 81, 82, by reason of the expansion of the spring 99, permitted by retreat of the cam surfaces 97, begin their spreading movement from the dot-dash position illustrated in FIG. 2. Pick-up of the sheet by the evacuated apertures on the face of the plenums is facilitated by the fact that the sheet, by reason of centrifugal force, tends to fly radially outwardly as the grippers 54 swing around the surface of drum 70.

As the leading edge portion of the sheet begins to wind about the sprocket drum 70 (FIG. 3*b*), it comes within the arc of suction, and the sheet, with both longitudinally extending and laterally extending ripples removed, is passed to the apertured surface of the drum 70 in taut and smooth condition. The spreading action of the plenums continues progressively as the sheet is progressively deposited upon the sprocket drum, as shown in FIG. 3*c*, until, finally, the end of the sheet is reached, at which time the axial and rocking motions of the plenums are reversed to restore the mechanism to the condition illustrated in FIG. 3. It is to be particularly noted that the stretching and smoothing of the sheet in the longitudinal and lateral directions occurs progressively along the length of the sheet and prior to the depositing of the sheet on the sprocket cylinder. There is no need, as in the above German disclosure document, to act upon the sheet after it has been deposited upon the drum, and an accurate condition of register is assured, not only upon the sprocket drum 70 but with respect to the grippers on the transfer drum 60 to which the sheet is conveyed, activation of the auxiliary grippers 62, which convey the sheet to the transfer drum 60 tail-first in the verso mode, being illustrated in FIG. 1*a*.

Although a typical verso sequence has been considered, it will be understood that FIGS. 3–3*c* are applicable, as well, to the recto mode in which the leading edge of the sheet, indicated dot-dash with numeral 121 (FIG. 3*b*), is gripped directly by the normal grippers 61. During the recto mode the valve 73 is, however, shut off since vacuum is not required in the sprocket drum.

In using the present invention means are preferably provided for maintaining the pressures in the two plenums at an equalized and adjusted level, with adjustment being effective to optimize the operation at different speeds and with different types and thicknesses of sheet stock. Such adjustment is conveniently effected by interposing an adjustable pressure regulating valve 130 (FIG. 2) between the source of vacuum 74 and lines 131, 132 which evacuate the interior spaces of the plenums.

While the invention described above is particularly applicable to a press intended for both recto and verso printing modes, the invention is not limited thereto and has utility in other press structures, wherever a conveyed sheet must be controlled and smoothed in two directions for depositing upon a receiving drum or cylinder in a condition of accurate register. Thus the term "conveyor" shall be construed as broad enough to include any conveying means and the term "sprocket drum" shall be construed broadly enough to cover any cylinder to which the sheet is applied after being smoothed and slightly stretched both laterally and longitudinally. Reference to a "pair" of plenums means that the structure shall include at least two plenums which are movable mutually toward and away from one another. While the plenums illustrarted at 81, 82 are in the form of evacuated chambers having apertured faces, and while such structure is preferred, it will be understood that the term "plenum" is not necessarily limited thereto but includes any means having a distributed pattern of suction apertures for simultaneously applying longitudinal and lateral frictional drag to a conveyed sheet. Also while the plenums 81, 82 should desirably produce a drag which is in the same direction longitudinally and balanced in opposite directions laterally, aptly described by the term "mirror image", it is not necessary in order to practice the invention that the two plenums be of identical mirror image construction.

What we claim is:

1. In a multi-color printing press the combination comprising a first press unit for printing on one side of a sheet, a second press unit for printing on one side of the sheet and having a transfer drum at its inlet, a conveyor extending from the first press unit to the second press unit, a press drive coupled to the press units and conveyor for operating the same in unison, the conveyor including a sprocket drum having a feed side and cooperating with the transfer drum for transfer of sheets to the latter, a pair of vacuum plenums having apertured faces alined with one another closely adjacent the feed side of the sprocket drum parallel to the axis thereof and spanning substantially the width of a sheet, the apertured faces including apertures in remote axial end portions thereof, the plenums being connected to a source of vacuum and being substantially mirror images of one another, and means couplied to the press drive and timed with the arrival of a sheet for axially spreading the plenums mutually outwardly during passage of the sheet thereby so that the faces of the plenums progressively wipe away any longitudinally extending as well as laterally extending wrinkles in the sheet as the sheet becomes progressively supported on the sprocket drum for sequential passage of the sheet in smooth condition and in accurate register via the sprocket and transfer drums.

2. In a multi-color printing press the combination comprising a first press unit for printing on one side of a sheet, a second press unit for printing on one side of the sheet and having a transfer drum at its inlet, a conveyor extending from the first press unit to the second press unit, a press drive coupled to the press units and conveyor for operating the same in unison, the conveyor including an apertured sprocket drum having a feed side and cooperating with the transfer drum for transfer of sheets to the latter, a first gripper on the transfer drum for engaging the leading edge of the sheet and a second gripper on the transfer drum for engaging the trailing edge of the sheet for printing in recto and verso modes, respectively, a pair of vacuum plenums having apertured faces alined with one another closely adjacent the feed side of the sprocket drum parallel to the axis thereof and spanning substantially the width of a sheet, the apertured faces including apertures in remote axial end portions thereof, the plenums being connected to a source of vacuum and being substantially mirror images of one another, means for connecting the apertures of the sprocket drum to the source of vacuum during printing in the verso mode, and means coupled to the press drive and timed with the arrival of a sheet for axially spreading the plenums mutually outwardly during passage of the sheet thereby, so that the faces of the plenums progressively wipe away any longitudinally extending as well as laterally extending wrinkles in the sheet as the sheet becomes progressively supported on the sprocket drum and prior to transfer thereof to the transfer drum for sequential passage of the sheet in smooth condition and in accurate register via the sprocket and transfer drums in both printing modes.

3. In a multi-color printing press the combination comprising a first press unit for printing on one side of a sheet, a second printing press for printing on one side of the sheet and having a transfer drum at its inlet, a conveyor extending from the first press unit to the second press unit having grippers spaced thereon, a press drive coupled to the press units and conveyor for operating the same in unison, the conveyor including a sprocket drum having a feed side and cooperating with the transfer drum for transfer of sheets to the latter, a pair of vacuum plenums having apertured faces alined with one another adjacent the feed side of the sprocket drum parallel to the axis thereof and spanning substantially the width of a sheet, the apertured faces including apertures in remote axial end portions thereof, the plenums being connected to a source of vacuum and being substantially mirror images of one another, means coupled to the press drive timed with the arrival of a sheet for axially spreading the plenums mutually outwardly during passage of the sheet so that the faces of the plenums progressively wipe away any longitudinally extending as well as laterally extending wrinkles on the sheet as the sheet becomes progressively supported on the sprocket drum and prior to transfer thereof to the transfer drum for sequential passage of the sheet in smooth condition and in accurate register via the sprocket and transfer drums, means for supporting the plenums with their faces upraised from the surface of the sprocket cylinder for clearing the grippers of the conveyor, and means timed with passage of each gripper for cyclically lowering the plenums into close proximity to the surface of the sprocket drum to initiate sucking engagement with a passing sheet.

4. In a printing press the combination comprising a press unit having a transfer drum at its inlet, the transfer drum having grippers, means including a conveyor for feeding sheets to the press unit, the conveyor having grippers, a press drive coupled to the press unit and conveyor for operating the same in unison, the conveyor including a sprocket drum having a feed side for supporting sheets during transfer of sheets from grippers on the conveyor to grippers on the transfer drum, a pair of vacuum plenums having apertured faces alined with one another closely adjacent the feed side of the sprocket drum parallel to the axis thereof and spanning substantially the width of the sheet, the apertured faces including apertures in remote axial end portions thereof, the plenums being connected to a source of vacuum and being substantially mirror images of one another, and means coupled to the press drive and timed with arrival of a sheet for axially spreading the plenums mutually outwardly from one another during passage of the sheet so that the faces of the plenums progressively wipe away any longitudinally extending as well as laterally extending wrinkles in the sheet as the sheet becomes progressively supported on the sprocket drum with the result that each sheet is fed into contact with the sprocket drum in a smooth and accurately registered condition for registered engagement by the grippers on the transfer drum.

5. The combination as claimed in claim 1 or claim 2 or claim 3 or claim 4 in which the faces of the plenums are of mating arcuate profile and in which the apertures therein are distributed over a large area in a two-dimensional pattern for distribution of the wiping forces over a large area of the sheet thereby to minimize development of localized stress within the sheet.

6. The combination as claimed in claim 1 or claim 2 or claim 3 or claim 4 in which the plenums each have a straight axially extending downstream edge with means distributed along the edge for applying vacuum substantially uniformly over the width of the sheet.

7. The combination as claimed in claim 1 or claim 2 or claim 3 or claim 4 in which the apertures in the faces of the plenums are concentrated at the remote axial end portions thereof, thereby concentrating the effect of suction along the lateral edges of the sheet.

8. The combination as claimed in claim 1 or claim 2 or claim 3 or claim 4 in which each plenum has a cam and cam follower for axially moving the same, the cams being coupled to the press drive for movement of the plenums in unison in opposite directions.

9. The combination as claimed in claim 3 in which the supporting and lowering means for each plenum includes a cam and cam follower coupled to the press drive for movement of the plenums cyclically in unison toward and away from the sprocket drum.

10. The combination as claimed in claim 1 or claim 2 or claim 3 or claim 4 in which an adjustable pressure regulating valve is interposed between the source of vacuum and the plenums for maintenance of a selected equal pressure in the latter.

11. The combination as claimed in claim 1 or claim 2 or claim 3 or claim 4 in which the plenums have straight alined edges on the downstream side with respect to the conveying direction, the faces of the plenums each having a slot extending along such edges, the vacuum tending to draw the sheet into the slots for application of drag to the sheet substantially evenly distributed along the width thereof.

* * * * *